US008084954B2

(12) United States Patent
Kim et al.

(10) Patent No.: US 8,084,954 B2
(45) Date of Patent: Dec. 27, 2011

(54) LAMP DRIVING CIRCUIT

(75) Inventors: Sung Ho Kim, Hwaseong-si (KR); Heung Gyoon Choi, Suwon-si (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 439 days.

(21) Appl. No.: 12/422,429

(22) Filed: Apr. 13, 2009

(65) Prior Publication Data

US 2009/0261754 A1 Oct. 22, 2009

(30) Foreign Application Priority Data

Apr. 18, 2008 (KR) ..... 10-2008-0036046
Jan. 5, 2009 (KR) ..... 10-2009-0000261

(51) Int. Cl.
*H05B 37/02* (2006.01)

(52) U.S. Cl. ..... 315/220; 315/224; 315/225; 315/226; 315/277; 315/278; 315/308

(58) Field of Classification Search ..... 315/209 R, 315/210, 219, 220, 221, 223, 224, 225, 226, 315/246, 250, 257, 276, 277, 278, 291, 307, 315/308

See application file for complete search history.

(56) References Cited

U.S. PATENT DOCUMENTS 7,274,156 B2 * 9/2007 Hsueh et al. ..... 315/254
7,365,501 B2 * 4/2008 Ushijima et al. ..... 315/278
7,477,023 B2 * 1/2009 Shimura et al. ..... 315/282
7,492,107 B2 * 2/2009 Wang et al. ..... 315/277
2004/0263092 A1 * 12/2004 Liu ..... 315/247
2005/0105305 A1 * 5/2005 Sawada et al. ..... 363/34
2007/0228987 A1 * 10/2007 Miyazaki et al. ..... 315/82
2008/0303447 A1 * 12/2008 Fukumoto ..... 315/206
2009/0039796 A1 * 2/2009 Lin et al. ..... 315/219

* cited by examiner

*Primary Examiner* — Thuy Vinh Tran
(74) *Attorney, Agent, or Firm* — Lowe, Hauptman, Ham & Berner, LLP

(57) ABSTRACT

The present invention relates to a lamp driving circuit capable of achieving miniaturization by using a safe insulation type multi-output transformer. The lamp driving circuit in accordance with the present invention includes a rectification unit for rectifying an input voltage; a PFC (Power Factor Correction) unit for enhancing a power factor of a voltage rectified by the rectification unit and converting the rectified voltage into a DC voltage; a switching unit for switching the DC voltage of the PFC unit in order to convert the DC voltage into a square wave voltage; an insulation transformer unit which includes a transformer to secure safe insulation by including an input terminal and a ground terminal of one primary side and all output terminals of first and second secondary sides each of which includes two output terminals at sides facing each other and a resonant capacitor, and outputs a plurality of driving voltages which have the same amplitude and drive a plurality of lamps respectively by receiving the square wave voltages outputted from the switching unit; and an insulation feedback unit for sensing any one of the plurality of driving voltages and transmitting the driving voltage to the switching unit positioned at the primary side of the transformer, wherein the insulation feedback unit insulates the primary side of the transformer from the secondary side of the transformer.

17 Claims, 6 Drawing Sheets

[FIG. 1]
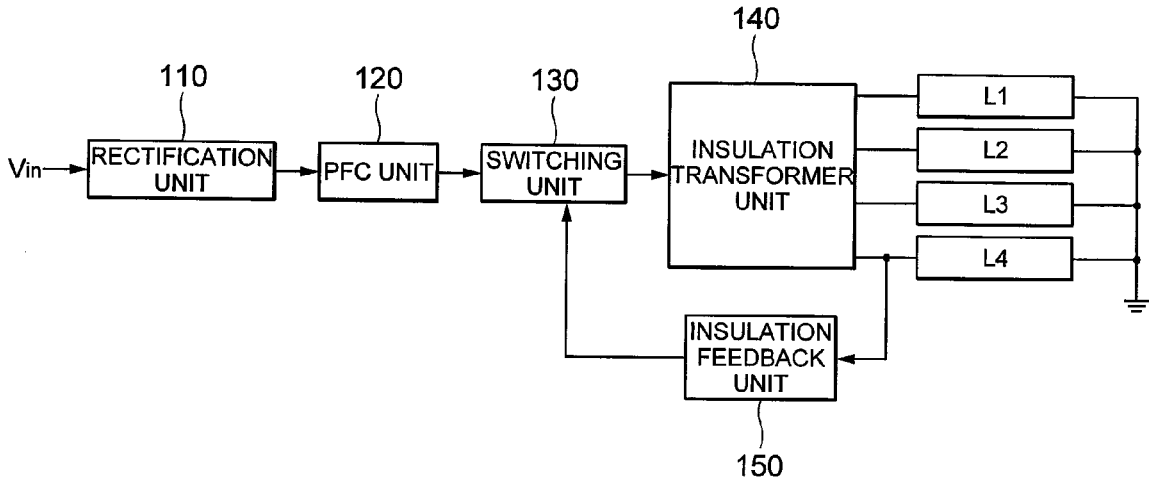

[FIG. 2]
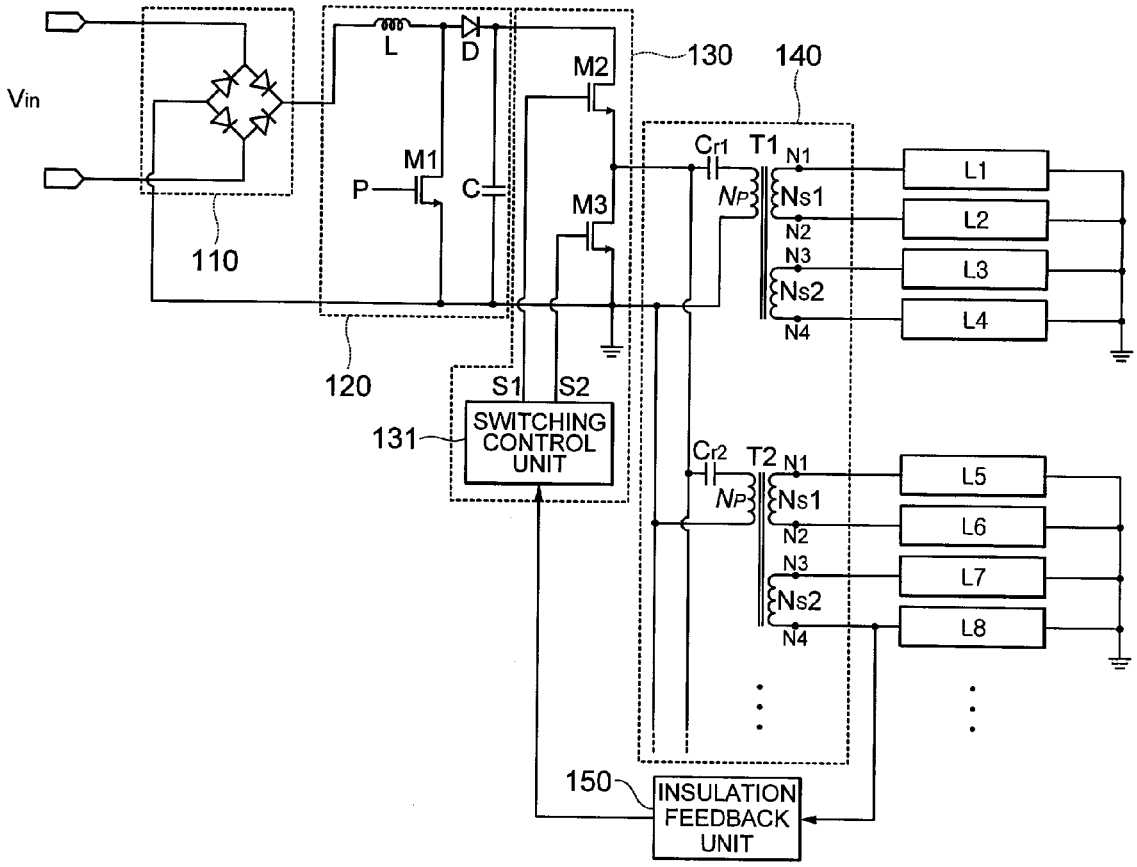

[FIG. 3]
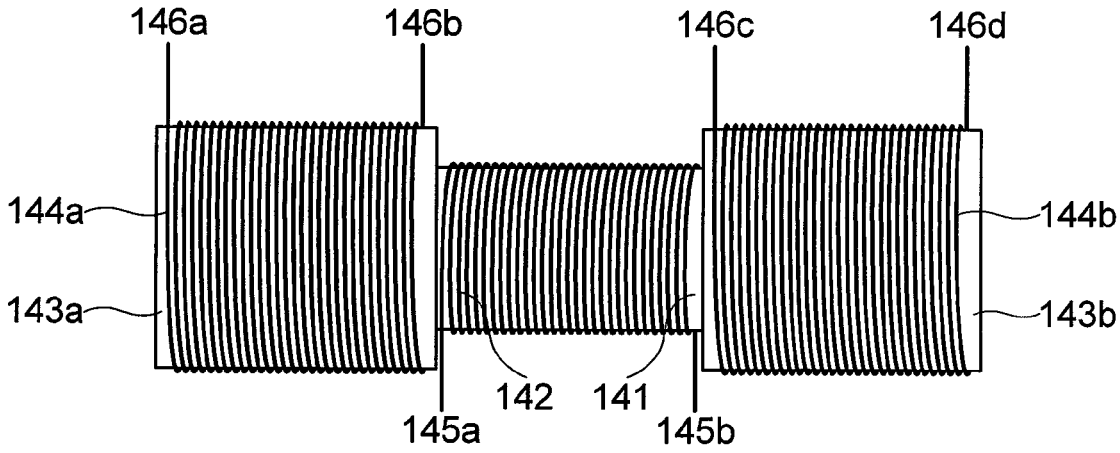

[FIG. 4]
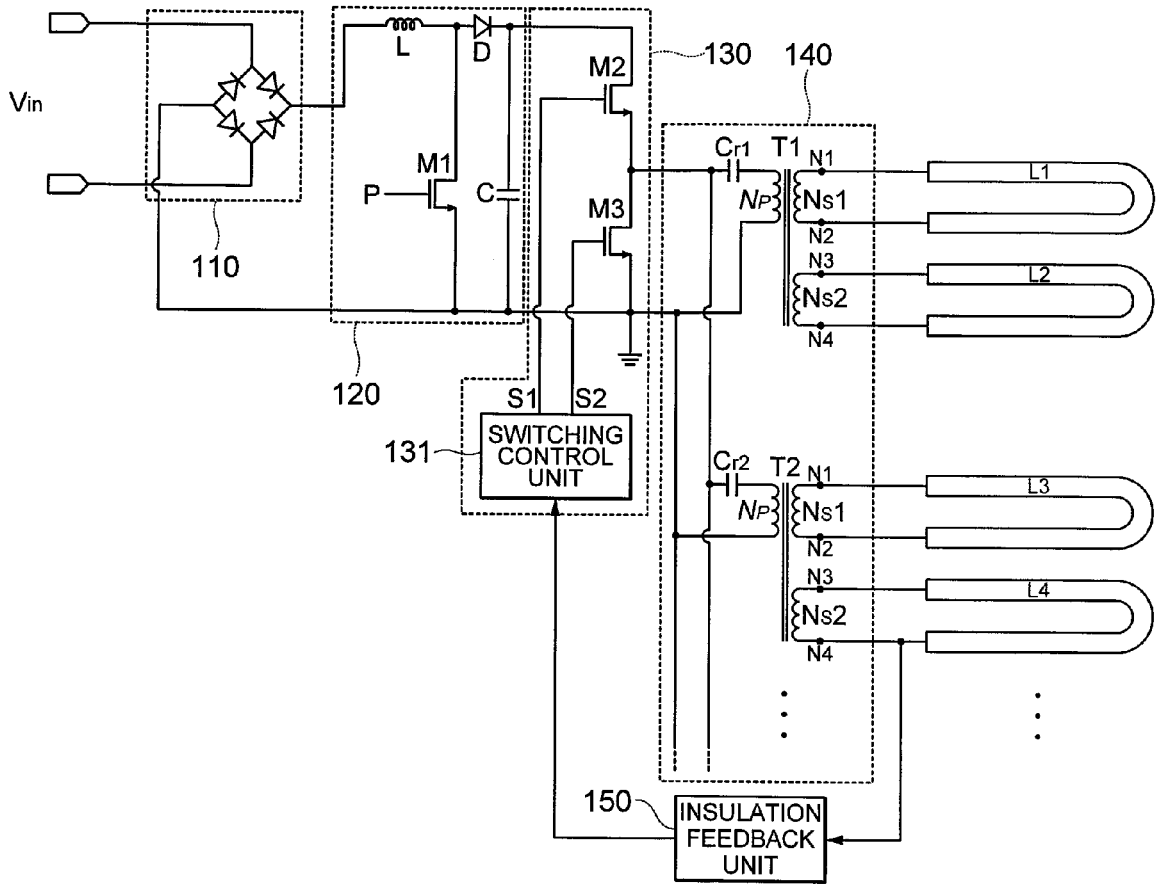

[FIG. 5]
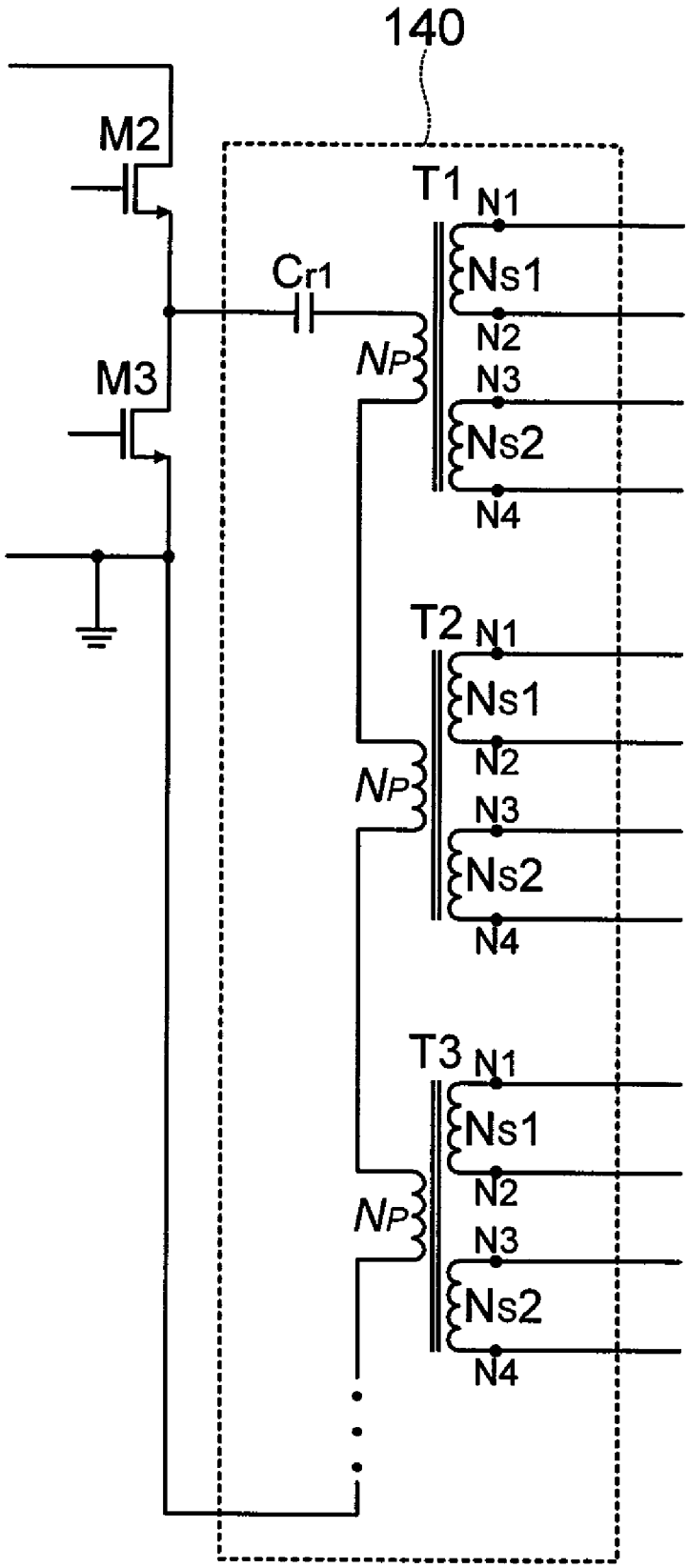

[FIG. 6]
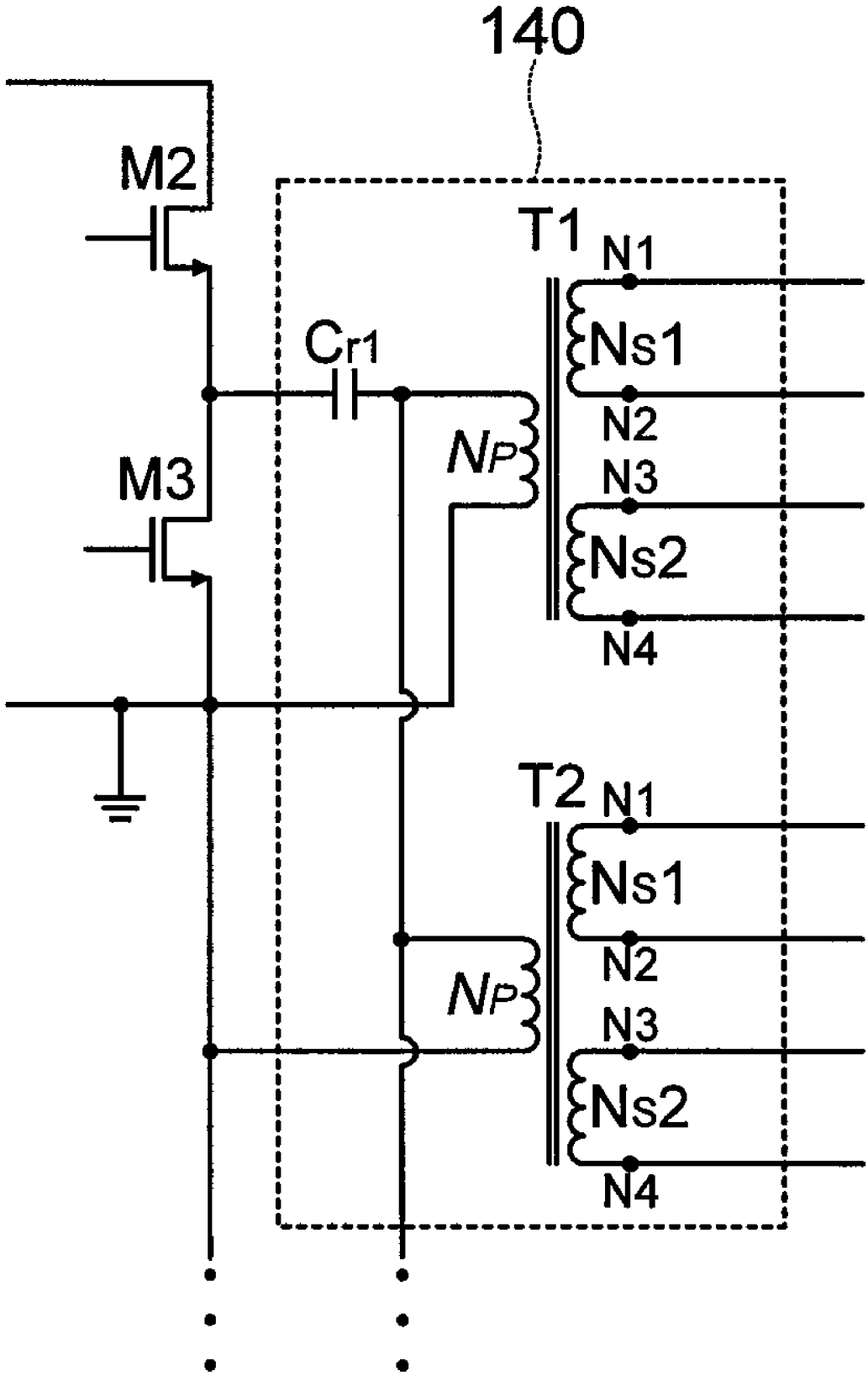

LAMP DRIVING CIRCUIT

CROSS-REFERENCE TO RELATED APPLICATIONS

This application claims the benefit of Korean Patent Application Nos. 10-2008-0036046 and 10-2009-0000261 filed with the Korea Intellectual Property Office on Apr. 18, 2008 and Jan. 5, 2009, the disclosures of which are incorporated herein by reference.

BACKGROUND OF THE INVENTION

1. Field of the Invention

The present invention relates to a lamp driving circuit; and, more particularly, to a lamp driving circuit capable of enhancing efficiency and reducing a cost by being simplified by driving a plurality of lamps through a transformer of which an input terminal of a primary side and an output terminal of a secondary side face each other to satisfy safe insulation and by being manufactured on a single board.

2. Description of the Related Art

A recent trend is that an LCD (Liquid Crystal Display) is gradually widely used for a TV and a monitor with development of display technology. When comparing the LCD to a CRT (Cathode-Ray Tube) monitor, the LCD has advantages in that a longitudinal cross-section is slimmed and a flicker is reduced.

Such an LCD includes a back-light module to supply a light source without self-luminescence and the back-light module has a fluorescent lamp which is driven at a high voltage.

Meanwhile, an inverter is used to drive the fluorescent lamp of the back-light module, wherein the inverter needs a high voltage transformer which supplies a current to the lamp constituting an LCD panel by generating a high AC output voltage with a low pulse input voltage.

At this time, because the conventional transformer supplies a single lamp driving voltage through a single transformer, a plurality of transformers are needed to drive a plurality of EEFLs (External Electrode Fluorescent Lamps) or CCFLs (Cold Cathode Fluorescent Lamps) in parallel.

Further, as an LCD TV and monitor market attains maturity, a selling price drops and thus prices of parts related to the back-light module continue to drop.

Therefore, due to price pressure of the parts related to the back-light module, a constant effort to reduce the number of the parts and a cost has been made and as part of the effort, movement to develop a product which can drive many lamps through one transformer has been progressed actively.

Through the development of the product, a new transformer has been recently developed to output driving voltages for separately driving a plurality of lamps by using one transformer. At this time, a plurality of driving voltages outputted from the multi-output transformer have different amplitudes.

In case that the amplitudes of all of the driving voltages are not equal, brightness of the plurality of lamps is different, thereby reducing reliability of the back-light module. Accordingly, coils are included at output stages of the transformer to balance the driving voltages, wherein the coils can achieve current balance with an adjacent lamp by being included in each of the lamps one by one.

However, since such a lamp driving method does not secure safe insulation, a 24 Vdc conversion unit or a one-to-one transformer is added at a front stage in order to secure the safe insulation, thereby reducing efficiency and raising a cost.

SUMMARY OF THE INVENTION

The present invention has been invented in order to overcome the above-described problems and it is, therefore, an object of the present invention to provide a lamp driving circuit capable of being manufactured on a single board by driving a plurality of lamps through a transformer to secure safe insulation by including an input terminal of a primary side and output terminals of a secondary side to face each other.

In accordance with one aspect of the present invention to achieve the object, there is provided a lamp driving circuit including a rectification unit for rectifying an input voltage; a PFC (Power Factor Correction) unit for enhancing a power factor of a voltage rectified by the rectification unit and converting the rectified voltage into a DC voltage; a switching unit for switching the DC voltage of the PFC unit in order to convert the DC voltage into a square wave voltage; an insulation transformer unit which includes a transformer to secure safe insulation by including an input terminal and a ground terminal of one primary side and all output terminals of first and second secondary sides each of which includes two output terminals at sides facing each other and a resonant capacitor, and outputs a plurality of driving voltages which have the same amplitude and drive a plurality of lamps respectively by receiving the square wave voltages outputted from the switching unit; and an insulation feedback unit for sensing any one of the plurality of driving voltages and transmitting the driving voltage to the switching unit positioned at the primary side of the transformer, wherein the insulation feedback unit insulates the primary side of the transformer from the secondary side of the transformer.

In accordance with another aspect of the present invention to achieve the object, there is provided a lamp driving circuit including a rectification unit for rectifying an input voltage; a PFC (Power Factor Correction) unit for enhancing a power factor of a voltage rectified by the rectification unit and converting the rectified voltage into a DC voltage; a switching unit for switching the DC voltage of the PFC unit in order to convert the DC voltage into a square wave voltage; an insulation transformer unit which includes a plurality of transformers to secure safe insulation by including an input terminal and a ground terminal of one primary side and all output terminals of first and second secondary sides each of which includes two output terminals at sides facing each other and at least one resonant capacitor, and outputs a plurality of driving voltages which have the same amplitude and drive a plurality of lamps respectively by receiving the square wave voltages outputted from the switching unit; and an insulation feedback unit for sensing any one of the plurality of driving voltages and transmitting the driving voltage to the switching unit positioned at the primary side of the transformer, wherein the insulation feedback unit insulates the primary side of the transformer from the secondary side of the transformer.

In accordance with the present invention, the switching unit includes a switching control unit for outputting first and second switching signals to output the square wave voltages with a predetermined amplitude by receiving the sensed driving voltages through the insulation feedback unit; a first switching device controlled to be turned on and off by receiving the first switching signal; and a second switching device controlled to be turned on and off by receiving the second switching signal.

In accordance with the present invention, the switching unit is formed in a half bridge or full bridge type.

In accordance with the present invention, each of the transformers of the insulation transformer unit includes a primary winding unit wound by a coil of the primary side and provided with the input terminal and the ground terminal; a first secondary winding unit wound by a coil of the first secondary side at one side of the primary winding unit and provided with the two output terminals; and a second secondary winding unit wound by a coil of the second secondary side at the other side of the primary winding unit and provided with the two output terminals.

In accordance with the present invention, the coils are wound around the first and second secondary winding units at the same number.

In accordance with the present invention, the coil of the primary side begins winding at the input terminal and finishes the winding at the ground terminal and the input terminal and the ground terminal are provided at the same side of the transformer.

In accordance with the present invention, the coils of the first and second secondary sides begin winding at any one of the output terminals and finish the winding at the other output terminal and the two output terminals are provided at a side facing the input terminal and the ground terminal of the primary side.

In accordance with the present invention, in the insulation transformer unit, one resonant capacitor is connected in serial to primary sides of the plurality of transformers which are connected to each other in series.

In accordance with the present invention, in the insulation transformer unit, the resonant capacitor is connected to a primary side of each of the transformers and the primary sides of the plurality of transformers connected to the resonant capacitor are connected in parallel.

In accordance with the present invention, in the insulation transformer unit, the one resonant capacitor is connected in serial to the primary sides of the plurality of transformers which are connected to each other in parallel.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which:

FIG. 1 is a block diagram showing a lamp driving circuit in accordance with the present invention;

FIG. 2 is a circuit view illustrating a lamp driving circuit in accordance with the present invention;

FIG. 3 is a plane-view illustrating a transformer of a lamp driving circuit in accordance with the present invention;

FIG. 4 is a circuit view showing a lamp driving circuit in accordance with a modified embodiment of the present invention;

FIG. 5 is a view illustrating a plurality of transformers of a lamp driving circuit in accordance with the present invention, of which primary sides are connected in series; and FIG. 6 is a view illustrating a plurality of transformers of a lamp driving circuit in accordance with the present invention, of which primary sides are connected in parallel.

DETAILED DESCRIPTION OF THE PREFERABLE EMBODIMENTS

A matter regarding to a configuration and an effect of a lamp driving circuit in accordance with the present invention will be appreciated clearly through the following detailed description with reference to the accompanying drawings illustrating preferable embodiments of the present invention.

Hereinafter, a lamp driving circuit in accordance with the present invention will be described in detail with reference to related drawings.

FIG. 1 is a block diagram showing a lamp driving circuit in accordance with the present invention, FIG. 2 is a circuit view illustrating a lamp driving circuit in accordance with the present invention, and FIG. 3 is a plane-view illustrating a transformer of a lamp driving circuit in accordance with the present invention.

At first, as shown in FIG. 1, the lamp driving circuit in accordance with the present invention includes a rectification unit 110, a PFC (Power Factor Correction) unit 120, a switching unit 130, an insulation transformer unit 140, and an insulation feedback unit 150 in order to drive four lamps L1~L4 at the same brightness.

The rectification unit 110, as illustrated in FIG. 2, includes a plurality of diodes and receives an input voltage Vin in order to rectify an electromagnetic wave. At this time, the diodes have a half bridge structure or a full bridge structure.

The PFC unit 120 includes an inductor L, a PWM (Pulse Width Modulation) switching device M1, a rectification diode D, and a smoothing capacitor C in order to improve a current power factor of a voltage rectified by the rectification unit 110 and convert the rectified voltage into a DC voltage with a predetermined amplitude.

One end of the inductor L of the PFC unit 120 is connected to the rectification unit 110 and the other end thereof is connected to a drain of the PWM switching device M1 and one end of the diode D. Further, the PWM switching device M1 of which the drain is connected to a common node of the inductor L and the diode D and a source is grounded and is on/off controlled by receiving a PWM control signal P through a gate.

And, the capacitor C is charged by a voltage which is controlled by the PWM switching device M1 and transmitted by connecting one end to a cathode of the diode D and grounding the other end.

The thus-constructed PFC unit 120 converts a voltage applied through the inductor L into a DC voltage having a predetermined amplitude by controlling the PWM switching device M1 with the PWM control signal P.

That is, in case that an amplitude of the DC voltage is smaller than an amplitude of the predetermined voltage, the amplitude of the DC voltage can be increased by increasing a duty width on period of the PWM control signal P to increase an on period of the PWM switching device M1.

Further, in case that the amplitude of the DC voltage is larger than the amplitude of the predetermined voltage, the amplitude of the DC voltage can be reduced by reducing the duty width on period of the PWM control signal P to reduce the on period of the PWM switching device M1.

The switching unit 130 includes a plurality of switching devices and a switching control unit 131 for controlling the switching devices and converts the DC voltage converted through the PFC unit 120 into a square wave voltage in order to output it. At this time, the switching unit 130 can be formed in a half bridge type or a full bridge type and in the present invention, the half bridge type switching unit 130 provided with first and second switching devices M2 and M3 is described.

The first switching device M2 of which a drain is connected to a contact of the diode D and the capacitor C of the PFC unit 120 and a source is connected to a drain of the second switching device M3, is controlled to be turned on and off by receiving a first switching signal S1 which is outputted from the switching control unit 131 through a gate.

Further, the second switching device M3 of which a drain is connected to the source of the first switching device M2 and a source is grounded, is controlled to be turned on and off by receiving a second switching signal S2 which is outputted from the switching control unit 131 through a gate.

And, the switching control unit 131 outputs the first and second switching signals S1 and S2 for controlling the first and second switching devices M2 and M3 in order to output a square wave voltage always having a predetermined amplitude by receiving through an insulation feedback unit 150 a feedback of a driving voltage which is outputted through an insulation transformer unit 140.

The thus-constructed switching unit 130 outputs the DC voltage outputted through the PFC unit 120 into the square wave voltage by alternately turning on and off the first switching device M2 and the second switching device M3 by the first and second switching signals S1 and S2 outputted from the switching control unit 131.

For instance, in case that the first switching device M2 is turned on by a high level of the first switching signal S1, the second switching device M3 is turned off by a low level of the second switching signal S2, so that the DC voltage outputted from the PFC unit 120 is transmitted to the insulation transformer unit 140 through the first switching device M2.

Further, in case that the second switching device M3 is turned on by a high level of the second switching signal S2, the first switching device M2 is turned off by a low level of the first switching signal, so that supply of the DC voltage outputted from the PFC unit 120 to the insulation transformer unit 140 is interrupted not to supply the DC voltage.

The switching unit 130 converts the DC voltage outputted from the PFC unit 120 into the square wave voltage in order to supply it to the insulation transformer unit 140 by repeating the operations.

Further, since the switching unit 130 can directly output the DC voltage having a high voltage such as 380V through the switching operation as a safely insulated sine wave voltage such as 1.8 KVa or 1.1 KVa, it is not necessary to include an additional DC to DC converter for reducing the conventional DC voltage of 380V.

Accordingly, the lamp driving circuit in accordance with the present invention can simplify configuration of the circuit and achieve miniaturization.

The insulation transformer unit 140 converts the square wave voltage supplied through the switching unit 130 into a plurality of driving voltages and outputs them in order to drive the plurality of lamps.

At this time, in case that the insulation transformer unit 140 outputs four driving voltages in order to drive the four lamps L1~L4 as shown in FIG. 1, it includes one transformer T1 and a resonant capacitor connected to a primary side of the transformer T1 and in order to drive a plurality of lamps L1~Ln as shown in FIG. 2, it includes n/4 transformers T1~T(n/4) and at least one resonant capacitor.

At first, a case that it includes the one transformer T1 will be described with reference to FIG. 3 hereinafter.

The transformer T1 has one primary side Np and two first and second secondary sides Ns1 and Ns2. At this time, the primary side Np of the transformer T1 has an input terminal 145*a* and a ground terminal 145*b* and a primary coil 142 is wound around a primary winding unit 141 provided at a central part of the transformer T1.

Particularly, the primary coil 142 of the transformer T1 begins winding at the input terminal 145*a* and finishes the winding at the ground terminal 145*b*. And, the input terminal 145*a* and the ground terminal 145*b* are arranged at one side of the transformer T1 in parallel.

Further, the first secondary side Ns2 of the transformer T1 is positioned around a first secondary winding unit 143*a* provided at one side of the primary winding unit 141 and includes two output terminals 146*a* and 146*b*.

At this time, a first secondary coil 144*a* wound around the first secondary winding unit 143*a* begins winding at one output terminal 146*a* and finishes the winding at the other output terminal 146*b* and the output terminals 146*a* and 146*b* are formed at the other side of the transformer T1 which faces the input terminal 145*a* and the ground terminal 145*b* of the primary coil 142.

As described above, the reason why the output terminals 146*a* and 146*b* of the first secondary coil 144*a* are not formed at the same side as the input terminal 145*a* and the ground terminal 145*b* of the primary coil 142 but formed at the side which faces them is to secure safe insulation between the primary and secondary sides because the first secondary side Ns1 of the transformer T1 has a high voltage.

In other words, in case that any one of the output terminals 146*a* and 146*b* of the first secondary coil 144*a* is formed at the same side as the input terminal 145*a*, the driving voltage outputted through the output terminal should be transmitted to a side facing the input terminal 145*a* again in order to secure an insulating distance so that the driving voltage is transmitted to the lamp.

At this time, in order to prevent an error generated when the high voltage flows in the first secondary winding unit 143*a* and so the output terminal of an input terminal side is cut off due to the high voltage, it is preferable that both of the output terminals 146*a* and 146*b* are formed at the side facing the input terminal 145*a* and the ground terminal 145*b* for insulation of the transformer T1.

Further, the second secondary side Ns2 of the transformer T1 is positioned around a second secondary winding unit 143*b* provided at a side facing the first secondary winding unit 143*a* with respect to the primary winding unit 141 and includes two output terminals 146*c* and 146*d*.

At this time, the second secondary winding unit 143*b* is constructed similar to the first secondary winding unit 143*a* and the output terminals 146*c* and 146*d* are also provided at the side facing the input terminal 145*a* and the ground terminal 145*b* in order to achieve the insulation.

Particularly, the transformer T1 provided in the lamp driving circuit in accordance with the present invention outputs driving voltages having the same amplitude because the first and second secondary coils 144*a* and 144*b* of the first and second secondary winding units 143*a* and 143*b* provided at both sides with respect to the primary winding unit 141 are wound at the same winding number.

As a result, in case that a plurality of driving voltages are outputted, the driving voltages always having the predetermined amplitude can be outputted through the first and second secondary winding units 143*a* and 143*b* wound by the first and second secondary coils 144*a* and 144*b* at the same winding number without including an additional balancing unit for balancing driving voltages having different amplitudes, thereby reducing the size of the circuit.

Further, since the transformer T1 of the insulation transformer unit 140 in accordance with the present invention can output the four driving voltages through the one transformer T1, in case that the four lamps L1~L4 are driven, all of the four lamps L1~L4 can be driven only through the one transformer T1, thereby reducing the volume.

And, as shown in FIG. 2, in case that the four or more lamps L1~Ln are driven, the lamps L1~Ln can be driven at the same brightness by connecting a resonant capacitor Cr1 to a primary side of each of the transformers and connecting the primary sides Np of the plurality of transformers T1~T(n/4)

respectively connected to the resonant capacitor Cr1 constructed as described above to each other in parallel.

Further, FIG. 5 is a view illustrating a plurality of transformers of a lamp driving circuit in accordance with the present invention, of which primary sides are connected in series. Referring to FIG. 5, a plurality of lamps L1~Ln can be driven at the same brightness by connecting in series one resonant capacitor Cr1 to primary sides of a plurality of transformers T1~T(n/4) which are connected to each other in series. In case that the plurality of transformers T1~T(n/4) and the resonant capacitor Cr1 are connected, since currents flowing to primary sides of all of the transformers are equal, a deviation of secondary side currents transmitted to drive the plurality of lamps L1~Ln is reduced.

Further, FIG. 6 is a view illustrating a plurality of transformers of a lamp driving circuit in accordance with the present invention, of which primary sides are connected in parallel. Referring to FIG. 6, a plurality of lamps L1~Ln can be driven at the same brightness by connecting in series one resonant capacitor Cr1 to primary sides of a plurality of transformers T1~T(n/4) which are connected to each other in parallel.

Particularly, the present invention can reduce manufacture process and time by being constructed in order to output the driving voltages having the same amplitude by using a single board provided with the lamp driving circuit compared to the prior art which increases a manufacture process by separately manufacturing an inverter board provided with a lamp driving circuit for outputting a plurality of driving voltages to drive a plurality of lamps L1~Ln and a balance board provided with a balancing unit.

Meanwhile, as shown in FIG. 4 which shows a lamp driving circuit in accordance with a modified embodiment of the present invention, in case that a "U" shaped lamp is driven instead of a straight-line lamp, one end of a first lamp L1 is connected to a high voltage terminal N1 of a first secondary side Ns1 of a transformer T1 and the other end thereof is connected to a low voltage terminal N2 of the first secondary side Ns1.

Further, one end of a second lamp L2 is connected to a high voltage terminal N3 of a second secondary side Ns2 of the transformer T1 and the other end thereof is connected to a low voltage terminal N4 of the second secondary side Ns2.

Consequently, since two "U" shaped lamps can be driven through one transformer T1, the number of transformers and the volume of the circuit can be reduced compared when one "U" shaped lamp is driven through one conventional transformer.

The insulation feedback unit 150 senses any one of the plurality of driving voltages outputted through the transformer and then transmits it to the switching unit 130 positioned at the primary side of the transformer. At this time, the insulation feedback unit 150 can play a role of insulating the primary side of the transformer from the secondary side thereof.

More specifically, the insulation feedback unit 150 senses any one of the plurality of driving voltages outputted through the transformer and then feedbacks it to the switching control unit 131 of the switching unit 130 and the switching control unit 131 outputs the first and second switching signals S1 and S2 for controlling the first and second switching devices M2 and M3 in order to output the square wave voltages always having the predetermined amplitude.

As described above, the lamp driving circuit in accordance with the present invention can achieve miniaturization by using the transformer where the current balance of the driving voltages is achieved by including the input terminal of the primary side and the output terminals of the secondary side at the sides facing each other.

In addition, the present invention can manufacture the lamp driving circuit for driving the plurality of lamps on the single board by using the transformer where the current balance is achieved, thereby reducing the cost and enhancing the efficiency.

As described above, although the preferable embodiments of the present invention have been shown and described, it will be appreciated by those skilled in the art that substitutions, modifications and changes may be made in these embodiments without departing from the principles and spirit of the general inventive concept, the scope of which is defined in the appended claims and their equivalents.

What is claimed is:

1. A lamp driving circuit comprising:

a rectification unit for rectifying an input voltage;

a PFC (Power Factor Correction) unit for enhancing a power factor of a voltage rectified by the rectification unit and converting the rectified voltage into a DC voltage;

a switching unit for switching the DC voltage of the PFC unit in order to convert the DC voltage into a square wave voltage;

an insulation transformer unit which includes a transformer to secure safe insulation by including an input terminal and a ground terminal of one primary side and all output terminals of first and second secondary sides each of which includes two output terminals at sides facing each other and a resonant capacitor, and outputs a plurality of driving voltages which include the same amplitude and drive a plurality of lamps respectively by receiving the square wave voltages outputted from the switching unit; and an insulation feedback unit for sensing any one of the plurality of driving voltages and transmitting the driving voltage to the switching unit positioned at the primary side of the transformer, wherein the insulation feedback unit insulates the primary side of the transformer from the secondary side of the transformer.

2. The lamp driving circuit of claim 1, wherein the switching unit includes:

a switching control unit for outputting first and second switching signals to output the square wave voltages with a predetermined amplitude by receiving the sensed driving voltages through the insulation feedback unit;

a first switching device controlled to be turned on and off by receiving the first switching signal; and a second switching device controlled to be turned on and off by receiving the second switching signal.

3. The lamp driving circuit of claim 1, wherein the switching unit is formed in a half bridge or full bridge type.

4. The lamp driving circuit of claim 1, wherein the transformer of the insulation transformer unit includes:

a primary winding unit wound by a coil of the primary side and provided with the input terminal and the ground terminal;

a first secondary winding unit wound by a coil of the first secondary side at one side of the primary winding unit and provided with the two output terminals; and a second secondary winding unit wound by a coil of the second secondary side at the other side of the primary winding unit and provided with the two output terminals.

5. The lamp driving circuit of claim 4, wherein the coils are wound around the first and second secondary winding units at the same number.

6. The lamp driving circuit of claim 4, wherein the coil of the primary side begins winding at the input terminal and finishes the winding at the ground terminal and the input terminal and the ground terminal are provided at the same side of the transformer.

7. The lamp driving circuit of claim 4, wherein the coils of the first and second secondary sides begin winding at any one of the output terminals and finish the winding at the other output terminal and the two output terminals are provided at a side facing the input terminal and the ground terminal of the primary side.

8. A lamp driving circuit comprising:

a rectification unit for rectifying an input voltage;

a PFC (Power Factor Correction) unit for enhancing a power factor of a voltage rectified by the rectification unit and converting the rectified voltage into a DC voltage;

a switching unit for switching the DC voltage of the PFC unit in order to convert the DC voltage into a square wave voltage;

an insulation transformer unit which includes a plurality of transformers to secure safe insulation by including an input terminal and a ground terminal of one primary side and all output terminals of first and second secondary sides each of which includes two output terminals at sides facing each other and at least one resonant capacitor, and outputs a plurality of driving voltages which include the same amplitude and drive a plurality of lamps respectively by receiving the square wave voltages outputted from the switching unit; and an insulation feedback unit for sensing any one of the plurality of driving voltages and transmitting the driving voltage to the switching unit positioned at the primary side of the transformer, wherein the insulation feedback unit insulates the primary side of the transformer from the secondary side of the transformer.

9. The lamp driving circuit of claim 8, wherein the switching unit includes:

a switching control unit for outputting first and second switching signals to output the square wave voltages with a predetermined amplitude by receiving the sensed driving voltages through the insulation feedback unit;

a first switching device controlled to be turned on and off by receiving the first switching signal; and a second switching device controlled to be turned on and off by receiving the second switching signal.

10. The lamp driving circuit of claim 8, wherein the switching unit is formed in a half bridge or full bridge type.

11. The lamp driving circuit of claim 8, wherein each of the transformers of the insulation transformer unit includes:

a primary winding unit wound by a coil of the primary side and provided with the input terminal and the ground terminal;

a first secondary winding unit wound by a coil of the first secondary side at one side of the primary winding unit and provided with the two output terminals; and a second secondary winding unit wound by a coil of the second secondary side at the other side of the primary winding unit and provided with the two output terminals.

12. The lamp driving circuit of claim 11, wherein the coils are wound around the first and second secondary winding units at the same number.

13. The lamp driving circuit of claim 11, wherein the coil of the primary side begins winding at the input terminal and finishes the winding at the ground terminal and the input terminal and the ground terminal are provided at the same side of the transformer.

14. The lamp driving circuit of claim 11, wherein the coils of the first and second secondary sides begin winding at any one of the output terminals and finish the winding at the other output terminal and the two output terminals are provided at a side facing the input terminal and the ground terminal of the primary side.

15. The lamp driving circuit of claim 8, wherein in the insulation transformer unit, one resonant capacitor is connected in serial to primary sides of the plurality of transformers which are connected to each other in series.

16. The lamp driving circuit of claim 8, wherein in the insulation transformer unit, the resonant capacitor is connected to a primary side of each of the transformers and the primary sides of the plurality of transformers connected to the resonant capacitor are connected in parallel.

17. The lamp driving circuit of claim 8, wherein in the insulation transformer unit, the one resonant capacitor is connected in serial to the primary sides of the plurality of transformers which are connected to each other in parallel.

* * * * *